US006797154B2

(12) United States Patent
Mukherjee et al.

(10) Patent No.: US 6,797,154 B2
(45) Date of Patent: Sep. 28, 2004

(54) HYDROCRACKING PROCESS FOR THE PRODUCTION OF HIGH QUALITY DISTILLATES FROM HEAVY GAS OILS

(75) Inventors: Ujjal Kumar Mukherjee, Montclair, NJ (US); Wai Seung W. Louie, Brooklyn, NY (US); Arthur J. Dahlberg, Benicia, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 49 days.

(21) Appl. No.: 10/104,185

(22) Filed: Mar. 21, 2002

(65) Prior Publication Data

US 2003/0111386 A1 Jun. 19, 2003

Related U.S. Application Data

(63) Continuation-in-part of application No. 10/025,411, filed on Dec. 17, 2001.

(51) Int. Cl.[7] ..... C10G 65/00; C10G 69/02; C10G 45/00

(52) U.S. Cl. ..... 208/58; 208/59; 208/89; 208/97; 208/210

(58) Field of Search ..... 208/55, 59, 89, 208/97, 210

(56) References Cited

U.S. PATENT DOCUMENTS

| | | | | | |
|---|---|---|---|---|---|
| 3,365,388 | A | * | 1/1968 | Scott | 208/59 |
| 3,592,757 | A | * | 7/1971 | Baral | 208/58 |
| 5,906,729 | A | * | 5/1999 | Chou | 208/89 |
| 5,980,729 | A | | 11/1999 | Kalnes et al. | 208/89 |
| 6,106,694 | A | | 8/2000 | Kalnes et al. | 208/57 |
| 6,224,747 | B1 | * | 5/2001 | Cash et al. | 208/58 |
| 6,514,403 | B1 | * | 2/2003 | Louie et al. | 208/58 |
| 6,547,956 | B1 | * | 4/2003 | Mukherjee et al. | 208/58 |

FOREIGN PATENT DOCUMENTS

WO 97/38066 10/1997 ..... C10G/65/12

* cited by examiner

*Primary Examiner*—Walter D. Griffin
*Assistant Examiner*—Tam M. Nguyen
(74) *Attorney, Agent, or Firm*—Penny L. Prater

(57) ABSTRACT

With this invention, high conversion of heavy gas oils and the production of high quality products is possible in a single high-pressure loop with reaction stages operating at different pressure and conversion levels. The flexibility offered is great and will allow the refiner to avoid decrease in product quality while at the same time minimizing capital cost. Feeds with varying boiling ranges can be introduced at different sections of the process, thereby minimizing the consumption of hydrogen and further reducing capital investment.

21 Claims, 1 Drawing Sheet

HYDROCRACKING PROCESS FOR THE PRODUCTION OF HIGH QUALITY DISTILLATES FROM HEAVY GAS OILS

CROSS-REFERENCE TO RELATED APPLICATIONS

This application is a Continuation-In-Part of U.S. application Ser. No. 10/025,411, filed Dec. 17, 2001.

FIELD OF THE INVENTION

This invention is directed to processes for the conversion of material boiling in the Vacuum Gas Oil boiling range to high quality middle distillates and/or naphtha and lighter products, and more particularly to a multiple stage process using a single hydrogen loop.

BACKGROUND OF THE INVENTION

In the refining of crude oil, gas oil hydrocrackers are used to convert heavy gas oils to lighter products using a single reaction stage or multiple reaction stages. In most instances, the various reaction stages operate at similar pressure levels. Where pressure levels are different, separate hydrogen loops are employed. Multiple reaction stages are used to achieve the following:

high conversion employing minimum reactor volume and catalyst volume overall better product qualities lower hydrogen consumption The use of multiple reaction systems however involves more equipment including multiple expensive high-pressure pumps and compressors.

U.S. Pat. No. 5,980,729 discloses a configuration with multiple reaction zones in a single hydrogen loop. The process uses a hot stripper downstream of the denitrification/desulfurization zone. Liquid from the hot stripper is pumped to the hydrocracking reactor upstream of the hydrotreating reactor. Recycle oil from the fractionation section is also pumped back to the hydrocracking reactor.

SUMMARY OF THE INVENTION

The process configuration for the instant invention is different from U.S. Pat. No. 5,980,729 in many aspects. The primary reactor is a combination hydrotreating-hydrocracking reactor that uses no recycle liquid.

Liquid from the hot stripper downstream of the reactor is reduced in pressure to a subsequent reaction stage where hydrocracking reactions are completed. No pump is involved in the transfer of liquid. Also, the second hydrocracking stage operates at lower pressure than the primary reaction stage.

With this invention, moderate to high conversion can be achieved using a single hydrogen loop. Product quality can be modulated to just meet specifications, eliminating product loss and saving hydrogen. The pressures of the reaction stages are maintained at levels suited for particular types of feed characteristics, i.e., only the first stage reactor that processes the most difficult feed must operate at the highest pressure level. High-temperature, high-pressure pumps are not involved in the process. The second hydrocracking reactor stage can operate in either co-current or counter-current mode with respect to the reaction gas, which in the present invention is primarily make-up hydrogen. The second hydrocracking reaction stage is fed with high purity make-up hydrogen to maximize hydrogen partial pressure.

The second stage is loaded with very high activity catalyst that can be used for hydrocracking at relatively low pressures. The invention is summarized below:

1. A method for hydroprocessing a hydrocarbon feedstock, said method employing multiple reaction zones within a single reaction loop, comprising the following steps:

(a) passing a hydrocarbonaceous feedstock to a first hydroprocessing zone having one or more beds containing hydroprocessing catalyst, the hydroprocessing zone being maintained at hydroprocessing conditions, wherein the feedstock is contacted with catalyst and hydrogen;

(b) passing the effluent of step (a) directly to a hot high pressure separator, wherein the effluent is contacted with a hot, hydrogen-rich stripping gas to produce a vapor stream comprising hydrogen, hydrocarbonaceous compounds boiling at a temperature below the boiling range of the hydrocarbonaceous feedstock, hydrogen sulfide, ammonia, and a bottoms stream comprising hydrocarbonaceous compounds boiling in approximately the same range of said hydrocarbonaceous feedstock along with a portion of the hydrocarbonaceous compounds boiling in the diesel boiling range;

(c) passing the vapor stream from step (b) after cooling and partial condensation to a hot hydrogen stripper containing at least one bed of hydrotreating catalyst, where it is contacted countercurrently with hydrogen, while the liquid stream of step (b) is passed to a second stage reactor;

(d) passing the overhead vapor stream from the hot hydrogen stripper of step (c), after cooling and contacting with water, to a first cold high pressure separator where hydrogen, hydrogen sulfide and light hydrocarbonaceous gases are removed overhead and a liquid stream comprising naphtha and middle distillates is passed to fractionation, thereby removing most of the ammonia and some of the hydrogen sulfide (as ammonium bi-sulfide in the sour water stream) as it leaves the cold high-pressure separator;

(e) passing the liquid stream from the hot hydrogen stripper of step (c) to a bed of hydroprocessing catalyst in the second reactor stage wherein the liquid is contacted under hydroprocessing conditions with the catalyst, in the presence of hydrogen;

(f) passing the overhead from the cold high pressure separator of step (d) to an amine absorber, where hydrogen sulfide is removed before hydrogen is compressed and recycled to hydroprocessing vessels within the loop;

(g) passing the hot high pressure separator bottoms of step (b) to a second reaction stage where it is contacted with at least one bed of hydrocracking catalyst in the presence of high purity hydrogen to produce a vapor stream and liquid effluent;

(h) passing the vapor stream of step (g) after cooling to a second cold high-pressure separator where a vapor stream is removed comprising primarily hydrogen and light hydrocarbonaceous gases;

(i) passing the liquid effluent of step (g), after cooling, to the cold high-pressure separator of step (h) to separate hydrogen and light hydrocarbonaceous gases from the liquid effluent;

(j) passing the vapor stream from steps (h) and (i) after further cooling and separation of condensate, to the make-up hydrogen compressor;

(k) passing the compressed hydrogen from the make-up hydrogen compressor to the primary reactor loop; and (l) passing the liquid effluent from steps (h) and (i) to the fractionation system.

BRIEF DESCRIPTION OF THE DRAWINGS

The FIGURE illustrates multiple reaction stages employing a single hydroprocessing loop.

DETAILED DESCRIPTION OF THE INVENTION

Description of FIG. 1

Figure 1:
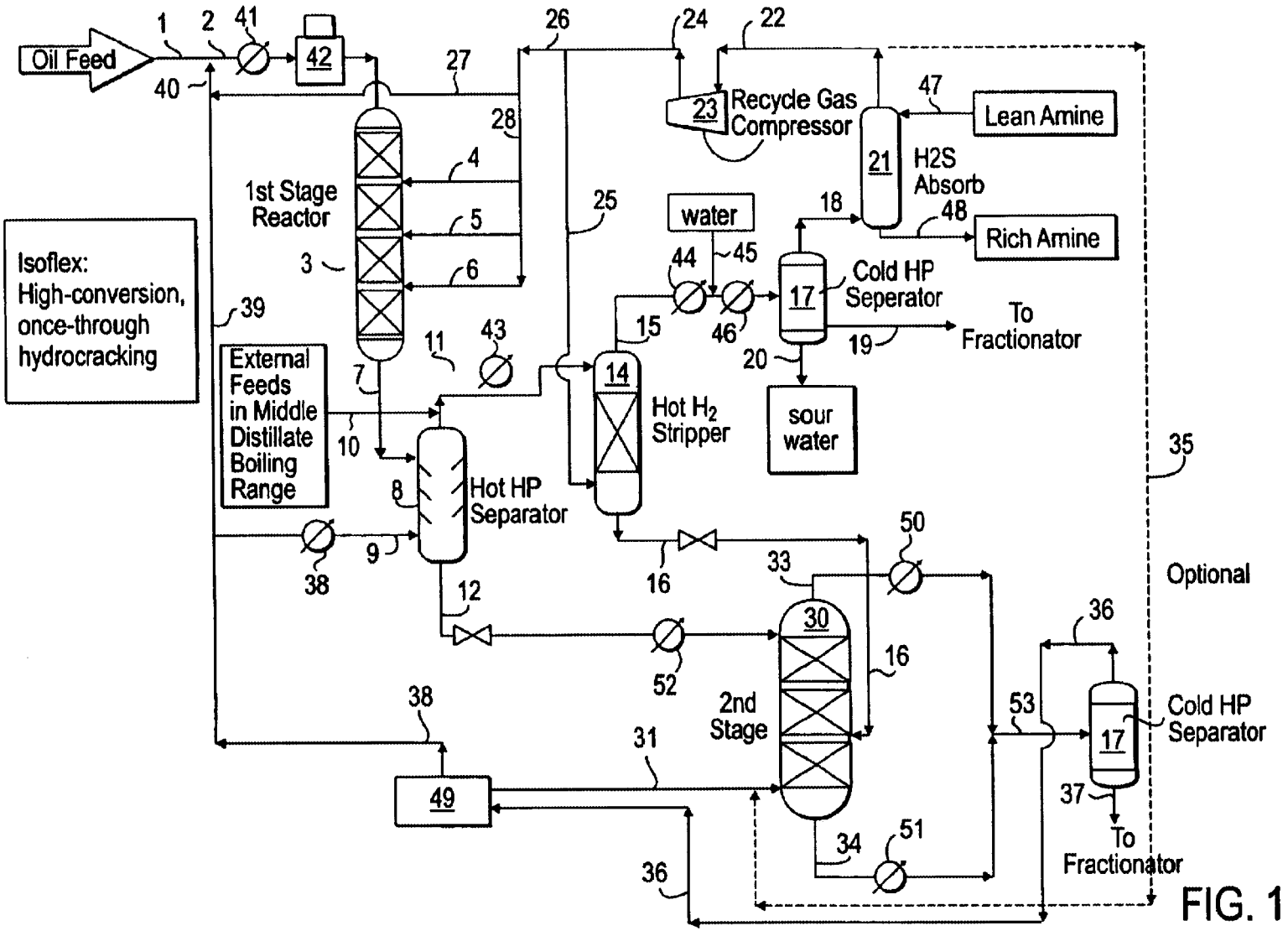

Preheated Oil feed in stream 1 is mixed with hydrogen in stream 40, which is preheated recycle and make-up hydrogen gas (reactor feed gas). The feed has been preheated in a process heat exchanger pumped up to the reactor pressure by the feed pump. The mixture of feed and reactor feed gas, now in stream 2, gets further preheated by heat exchange (in exchanger 41) and a final furnace (42) before it enters the first stage, downflow fixed bed primary reactor (3). The primary or first stage reactor contains multiple beds of hydroprocessing catalysts which may be beds of either hydrotreating or hydrocracking catalysts. Cold hydrogen from the recycle gas compressor is used as interbed quench (4,5,6).

The effluent 7 of the first stage reactor, which has been hydrotreated and partially hydrocracked, contains hydrogen sulfide, ammonia, light gases, naphtha, middle distillate, and hydrotreated vacuum gas oil. The effluent enters the hot high pressure separator (8) at slightly lower pressure and at slightly lower temperature, where most of the diesel and lighter material is separated from the unconverted oil. The hot high pressure separator has disc and doughnut type trays. Hydrogen rich gas, heated in exchanger 38, is introduced at the bottom for stripping through stream 9.

Stream 11 contains the overhead from the hot high-pressure separator. At this point, external feeds boiling in the middle-distillates boiling range such as Light Cycle Oil (LCO), Light Coker Gas Oil (LCGO), Atmospheric Gas Oil (AGO), Light Visbreaker Gas Oil (LVBGO), etc., can be introduced (10). Stream 11 is cooled by process heat exchange or by steam generation before entering the high-pressure hydrogen stripper-hydrotreater (14). Liquid in stream 11 flows downward through a bed of packing containing hydrotreating catalyst, while being contacted with countercurrent flowing hydrogen from stream 25.

The overhead stream 15 contains primarily hydrogen, ammonia and hydrogen sulfide, along with some light gases and naphtha. It is cooled by process heat exchange (44), contacted with water (45), and further cooled by air cooling (46) before being fed to the Cold High Pressure Separator No. 1 (17). The water injection allows the removal of most of the ammonia from the hydrogen gas as ammonium bisulfide solution. Hydrogen, hydrogen sulfide and light hydrocarbonaceous gases are removed overhead as stream 18. Stream 20 is a sour water stream containing ammonium bisulfide. Stream 19 is a hydrocarbonaceous stream containing naphtha, kerosene and diesel range products. Stream 18 is sent to an amine absorber (21) where almost the entire quantity of hydrogen sulfide is removed from the hydrogen-rich stream by contacting with amine (47). After removal of the hydrogen sulfide, the gas is sent for compression to the recycle gas compressor (23). The compressed recycle gas (24) is split into streams 25 and 26. Stream 26 is further split into the first stage recycle gas feed (27) and stream 28 that supplies the quench to the first stage.

Bottoms from the hot high-pressure separator, stream 12, can be reduced in pressure and cooled down by process heat exchange before being fed to the second stage reactor (30) where hydrocracking reactions are completed and unconverted material in stream 12 is further converted to diesel and lighter products. The second stage reactor is fed with high purity make-up hydrogen (31) from an intermediate stage of the make-up hydrogen compressor (49). The hydrogen, in the preferred mode, flows up the reactor in countercurrent fashion for maximizing the benefits of hydrogen partial pressure. The invention will also work with co-current introduction of make-up hydrogen. The second stage reactor feed gas requirements in terms of adequate gas-to-oil ratio can be met by introducing all of the make-up hydrogen required in all reaction stages to the front of second stage reactor. The invention has the provision, however, to introduce recycle hydrogen from the recycle gas compressor through stream 35.

The second reaction stage operates under a clean, ammonia and hydrogen sulfide free environment and thus hydrocracking rate constants are much higher. Catalyst deactivation is much reduced. These factors enable the operation at lower hydrogen partial pressures and with reduced catalyst requirements.

The lower bed or beds of the second stage reactor (30) can be loaded with hydrotreating catalyst where diesel range material (16) from the hydrogen stripper (14) can be introduced for completion of aromatic saturation and other hydroprocessing reactions. Alternately, stream 16 can be diverted directly to the fractionation section if the diesel quality is adequate.

There are at least two, preferably three to four, beds of hydroprocessing catalyst in reactor 30. The catalyst can be either base metal or noble metal hydroprocessing catalyst.

Stream 33, which comes from the top of the reactor, contains primarily hydrogen, although some $H_2S$ and ammonia may be present. It is cooled by process heat exchange (50) before being sent to Cold High Pressure Separator No. 2 (17). The overhead vapor of Cold High Pressure Separator No. 2 passes to the make-up hydrogen compressor (49), to the final stage of compression.

The liquid effluent from reactor 30, Stream 34, which contains light gases, naphtha, middle distillate and hydrotreated gas oil, is cooled by process heat exchange (51) and sent to Cold High Pressure Separator No. 2 (17).

Bottoms from the Cold High Pressure Separator No. 2 is sent to fractionation.

The Make-up hydrogen compressor (49) is a multi-stage machine with typically three to four compression stages. After each stage of compression, the gas is cooled and any condensate knocked out in a knock-out drum (KOD). For this invention, the gas to the second reaction stage is withdrawn after an intermediate stage of compression. The gas stream (31) is sent to the second reaction stage (30) and is returned via the Cold High Pressure Separator No. 2 (stream 36) to the final stage of compression of the make-up hydrogen compressor.

After the final stage of compression, the high-pressure make-up hydrogen is sent to the first reaction stage, stream 39 and to the hot separator.

Feeds

A wide variety of hydrocarbon feeds may be used in the instant invention. Typical feedstocks include any heavy or synthetic oil fraction or process stream having a boiling point above 392° F. (200° C.). Such feedstocks include vacuum gas oils, heavy atmospheric gas oil, delayed coker gas oil, visbreaker gas oil demetallized oils, vacuum residua, atmospheric residua, deasphalted oil, Fischer-Tropsch streams, and FCC streams.

Products

The process of this invention is especially useful in the production of middle distillate fractions boiling in the range of about 250–700° F. (121–371° C.). A middle distillate fraction is defined as having an approximate boiling range from about 250 to 700° F. At least 75 vol %, preferably 85 vol %, of the components of the middle distillate have a normal boiling point of greater than 250° F. At least about 75 vol %, preferably 85 vol %, of the components of the middle distillate have a normal boiling point of less than 700° F. The term "middle distillate" includes the diesel, jet fuel and kerosene boiling range fractions. The kerosene or jet fuel boiling point range refers to the range between 280 and 525° F. (38–274° C.). The term "diesel boiling range" refers to hydrocarbons boiling in the range from 250 to 700° F. (121–371° C.).

Gasoline or naphtha may also be produced in the process of this invention. Gasoline or naphtha normally boils in the range below 400° F. (204° C.), or $C_5$-. Boiling ranges of various product fractions recovered in any particular refinery will vary with such factors as the characteristics of the crude oil source, local refinery markets and product prices.

Heavy hydrotreated gas oil, another product of this invention, usually boils in the range from 550 to 700° F.

Conditions

Hydroprocessing conditions is a general term which refers primarily in this application to hydrocracking or hydrotreating, preferably hydrocracking. The first stage reactor, as depicted in FIG. 1, is a partial conversion hydrocracker.

Typical hydrocracking conditions include a reaction temperature of from 400° F.–950° F. (204° C.–510° C.), preferably 650° F.–850° F. (343° C.–454° C.). Reaction pressure ranges from 500 to 5000 psig (3.5–4.5 MPa), preferably 1500–3500 psig (10.4–24.2 MPa). LHSV ranges from 0.1 to $15^{hr-1}$ (v/v), preferably 0.25–2.5 $hr^{-1}$. Hydrogen consumption ranges from 500 to 2500 SCF per barrel of liquid hydrocarbon feed (89.1–445 $m^3$ $H_2/m^3$ feed).

Catalyst

Each hydroprocessing zone may contain only one catalyst, or several catalysts in combination.

The hydrocracking catalyst generally comprises a cracking component, a hydrogenation component, and a binder. Such catalysts are well known in the art. The cracking component may include an amorphous silica/alumina phase and/or a zeolite, such as a Y-type or USY zeolite. Catalysts having high cracking activity often employ REX, REY and USY zeolites. The binder is generally silica or alumina. The hydrogenation component will be a Group VI, Group VII, or Group VIII metal or oxides or sulfides thereof, preferably one or more of iron, chromium, molybdenum, tungsten, cobalt, or nickel, or the sulfides or oxides thereof. If present in the catalyst, these hydrogenation components generally make up from about 5% to about 40% by weight of the catalyst. Alternatively, noble metals, especially platinum and/or palladium, may be present as the hydrogenation component, either alone or in combination with the base metal hydrogenation components: iron, chromium molybdenum, tungsten, cobalt, or nickel. If present, the platinum group metals will generally make up from about 0.1% to about 2% by weight of the catalyst.

Hydrotreating catalyst usually is designed to remove sulfur and nitrogen and provide a degree of aromatic saturation. It will typically be a composite of a Group VI metal or compound thereof, and a Group VIII metal or compound thereof supported on a porous refractory base such as alumina. Examples of hydrotreating catalysts are alumina supported cobalt-molybdenum, nickel sulfide, nickel-tungsten, cobalt-tungsten and nickel-molybdenum. Typically, such hydrotreating catalysts are presulfided.

Catalyst selection is dictated by process needs and product specifications. In particular, a noble catalyst may be used in the second stage when there is a low amount of $H_2S$ present. A low acidity catalyst may be used in the bottom of the second stage hydrocracker in order to avoid overcracking distillate to gas and naphtha.

EXAMPLE

These are the conditions and results obtained using the process depicted in FIG. 1:

| | Stage 1 | Hydrogen Stripper/Hydrotreater | Stage 2 |
|---|---|---|---|
| Catalyst Hydrogenation Component | Base metal | Base metal | Base metal or Noble Metal |
| LHSV, $hr^{-1}$ | 0.3–3.5 | 0.3–2.0 | 0.5–7.0 |
| Operating Temperature, ° C. | 300–440 | 250–400 | 250–440 |
| Reactor Inlet Pressure, kg/cm2g | 100–230 | 90–220 | 80–170 |
| Gas/Oil Ratio Nm3/m3 | 160–1500 | 160–1500 | 160–850 |
| Conversion, % | 20–70 | | 25–75 |
| Kerosene Smoke Point, mm | 13–25 | | 20–40 |
| Diesel Cetane Number | 30–55 | | 50–75 |

Generally, cetane uplift is 20 to 45 and improvement in kerosene smoke point is 7–27 mm.

What is claimed is:

1. A method for hydroprocessing a hydrocarbon feedstock, said method employing multiple reaction zones within a single reaction loop, comprising the following steps:

(a) passing a hydrocarbonaceous feedstock to a first hydroprocessing zone having one or more beds containing hydroprocessing catalyst, the hydroprocessing zone being maintained at hydroprocessing conditions, wherein the feedstock is contacted with catalyst and hydrogen;

(b) passing the effluent of step (a) directly to a hot high pressure separator, wherein the effluent is contacted with a hot, hydrogen-rich stripping gas to produce a vapor stream comprising hydrogen, hydrocarbonaceous compounds boiling at a temperature below the boiling range of the hydrocarbonaceous feedstock, hydrogen sulfide, and ammonia, as well as a bottoms stream comprising heavier components;

(c) passing the vapor stream from step (b) after cooling and partial condensation to a hot hydrogen stripper containing at least one bed of hydrotreating catalyst, where it is contacted countercurrently with hydrogen, thereby producing an overhead effluent comprising hydrogen, hydrogen sulfide, light hydrocarbonaceous gases and ammonia, as well as a heavier stripper bottoms stream while the separator bottoms stream of step (b) is passed to a second stage reactor;

(d) passing the overhead effluent stream of step (c) from the hot hydrogen stripper of step (c), after cooling and contacting with water, to a first cold high pressure separator where hydrogen, hydrogen sulfide and light hydrocarbonaceous gases are removed overhead and a liquid stream comprising naphtha and middle distillates is passed to a fractionation system, thereby removing most of the ammonia and some of the hydrogen sulfide (as ammonium bi-sulfide in the sour water stream as it leaves the cold high-pressure separator);

(e) passing the stripper bottoms stream from the hot hydrogen stripper of step (c) to a bed of hydroprocessing catalyst in the second stage reactor of step (c) wherein the stripper bottoms are contacted under hydroprocessing conditions with the catalyst, in the presence of hydrogen;

(f) passing the overhead from the cold high pressure separator of step (d) to an amine absorber, where hydrogen sulfide is removed before hydrogen is compressed and recycled to hydroprocessing vessels within the loop;

(g) contacting the separator bottoms of step (b) in a the second stage reactor of step (c) with at least one bed of hydrocracking catalyst in the presence of hydrogen to produce a vapor stream and liquid effluent;

(h) passing the vapor stream of step (g) after cooling to a second cold high-pressure separator where a vapor stream is removed comprising primarily hydrogen and light hydrocarbonaceous gases:

(i) passing the liquid effluent of step (g) after cooling to the cold high-pressure separator of step (h) to separate hydrogen and light hydrocarbonaceous gases from the liquid effluent;

(j) passing the vapor stream from steps (h) and (i) after further cooling and separation of condensate, to a make-up hydrogen compressor;

(k) passing the compressed hydrogen from the make-up hydrogen compressor of step j to the primary reactor loop; and (l) passing the liquid effluent from steps (h) and (i) to the fractionation system.

2. The process of claim 1, step (g), in which the hydrogen comes from an intermediate compression stage of the make-up hydrogen compressor.

3. The process of claim 1, step (g), in which the hydrogen flows in a co-current direction to the liquid effluent of claim 1, step (b).

4. The process of claim 1, step (g), in which the hydrogen flows in a countercurrent direction to the liquid effluent of claim, step (b).

5. The process of claim 1, wherein the hydroprocessing conditions of claim 1, step (a), comprise a reaction temperature of from 400° F.–950° F. (204° C.–510° C.), a reaction pressure in the range from 500 to 5000 psig (3.5–34.5 MPa), an LHSV in the range from 0.1 to 15 $hr^{-1}$ (v/v), and hydrogen consumption in the range from 500 to 2500 scf per barrel of liquid hydrocarbon feed (89.1–445 $m^3$ $H_2/m^3$ feed).

6. The process of claim 5, wherein the hydroprocessing conditions of claim 1, step (a), preferably comprise a temperature in the range from 650° F.–850° F. (343° C.–454° C.), reaction pressure in the range from 1500–3500 psig (10.4–24.2 MPa), LHSV in the range from 0.25 to 2.5 $hr^{-1}$, and hydrogen consumption in the range from 500 to 2500 scf per barrel of liquid hydrocarbon feed (89.1–445 $m^3$ $H_2/m^3$ feed).

7. The process of claim 1, wherein the hydroprocessing conditions of claim 1, step (e), comprise a reaction temperature of from 400° F.–950° F. (204° C.–510° C.), a reaction pressure in the range from 500 to 5000 psig (3.5–34.5 MPa), an LHSV in the range from 0.1 to 15 $hr^{-1}$ (v/v), and hydrogen consumption in the range from 500 to 2500 scf per barrel of liquid hydrocarbon feed (89.1–445 $m^3$ $H_2/m^3$ feed).

8. The process of claim 7, wherein the hydroprocessing conditions of claim 1, step (e), preferably comprise a temperature in the range from 650° F.–850° F. (343° C.–454° C.), reaction pressure in the range from 1500–3500 psig (10.4–24.2 MPa), LHSV in the range from 0.25 to 2.5 $hr^{-1}$, and hydrogen consumption in the range from 500 to 2500 scf per barrel of liquid hydrocarbon feed (89.1–445 $m^3$ $H_2/m^3$ feed).

9. The process of claim 1, wherein the feedstock to claim 1, step (a), comprises hydrocarbons boiling above 392° F. (200° C.).

10. The process of claim 9, wherein the feedstock is selected from the group consisting of vacuum gas oil, heavy atmospheric gas oil, delayed coker gas oil, visbreaker gas oil, demetallized oils, FCC light cycle oil, vacuum residua deasphalted oil, Fischer-Tropsch streams, and FCC streams.

11. The process of claim 1, wherein the cetane number improvement occurring in step (e) ranges from 20 to 45.

12. The process of claim 1, wherein the kerosene smoke point improvement occurring in step (e) ranges from 7 to 27.

13. The process of claim 1, wherein the second hydroprocessing zone of step (e) is maintained at a lower pressure than that of the first hydroprocessing zone of step (a).

14. The process of claim 1, wherein the hydroprocessing catalyst of both stage 1 and stage 2 comprises both a cracking component and a hydrogenation component.

15. The process of claim 14, wherein the hydrogenation component is selected from Group VI, Group VII or Group VIII metals.

16. The process of claim 15, wherein the hydrogenation component is selected from the group consisting of Ni, Mo, W, Pt and Pd or combinations thereof.

17. The process of claim 15, wherein the Group VI, Group VII or Group VIII metals may exist as either sulfides or oxides.

18. The process of claim 12, wherein the hydrogenation component comprises 5 to 40 wt. % of the catalyst.

19. The process of claim 14, wherein noble metals comprise from about 0.1 wt. % to about 2 wt. % of the catalyst.

20. The process of claim 12, wherein the cracking component may be amorphous or zeolitic.

21. The process of claim 14, wherein the zeolitic component is selected from the group consisting of Y, USY, REX, and REY zeolites.

* * * * *